US007931130B2

(12) United States Patent
Ring

(10) Patent No.: US 7,931,130 B2
(45) **Date of Patent: *Apr. 26, 2011**

(54) UNIVERSAL BRAKE ASSEMBLY

(75) Inventor: Michael E. Ring, Saint John, IN (US)

(73) Assignee: WABTEC Holding Corp, Wilmerding, PA (US)

( * ) Notice: Subject to any disclaimer, the term of this patent is extended or adjusted under 35 U.S.C. 154(b) by 1331 days.

This patent is subject to a terminal disclaimer.

(21) Appl. No.: 11/480,804

(22) Filed: Jul. 3, 2006

(65) Prior Publication Data

US 2007/0023241 A1 Feb. 1, 2007

Related U.S. Application Data

(60) Provisional application No. 60/696,942, filed on Jul. 6, 2005.

(51) Int. Cl.
*B60T 11/10* (2006.01)

(52) U.S. Cl. ..... 188/153 D; 188/124; 188/365; 188/366; 188/367; 188/368; 303/22.6

(58) Field of Classification Search ..... 188/124, 188/153 R, 365–368; 303/22.6
See application file for complete search history.

(56) References Cited

U.S. PATENT DOCUMENTS

| | | | | |
|---|---|---|---|---|
| 3,589,481 | A * | 6/1971 | Motsch et al. | 188/345 |
| 4,467,605 | A * | 8/1984 | Smith | 60/577 |
| 4,722,516 | A | 2/1988 | Gregg | |
| 4,787,606 | A * | 11/1988 | Geno et al. | 267/64.27 |
| 4,846,785 | A * | 7/1989 | Cassou et al. | 600/34 |
| 5,069,312 | A * | 12/1991 | Kanjo et al. | 188/52 |
| 5,201,500 | A * | 4/1993 | Ecktman et al. | 267/140 |
| 5,580,033 | A | 12/1996 | Burkley et al. | |
| 5,921,532 | A * | 7/1999 | Pierce et al. | 267/64.19 |
| 6,116,385 | A * | 9/2000 | Ring | 188/153 D |
| 6,230,851 | B1 * | 5/2001 | Yoshizawa et al. | 188/71.1 |
| 6,792,704 | B2 * | 9/2004 | Johnson | 37/235 |
| 6,845,973 | B2 | 1/2005 | Ferrer | |
| 6,926,264 | B1 | 8/2005 | Trowbridge | |
| 2005/0040575 | A1 * | 2/2005 | Ring et al. | 267/140.12 |
| 2007/0228623 | A1 * | 10/2007 | Egolf et al. | 267/118 |

FOREIGN PATENT DOCUMENTS

| | | |
|---|---|---|
| EP | 1 187 335 | 9/1959 |
| EP | 0 872 664 | 10/1998 |
| EP | 1 070 644 | 10/2000 |
| RU | 2248897 | 3/2005 |

OTHER PUBLICATIONS

PCT/US/2006/026125 Universal Brake Assembly, 2006.

* cited by examiner

*Primary Examiner* — Bradley T King
*Assistant Examiner* — James K Hsiao
(74) *Attorney, Agent, or Firm* — James Ray & Assoc

(57) ABSTRACT

A brake actuator assembly for a railway vehicle braking system comprises a flexible elastomeric member directly and sealably attached to a mounting member employed for attaching the brake actuator assembly to the rigid structure of a braking system and to a push rod member connected to the control linkage. The brake actuator assembly is connected to a source of fluid under pressure enabling inflation of the flexible elastomeric member and initiation of a braking sequence of the railway vehicle braking system. The brake actuator assembly of the present invention allows for improved control of the brake shoe forces including visual travel measurement indication which is especially desirable during light load conditions. Currently used brake assemblies employing cylinder type actuators may be retrofitted with the brake actuator assembly of the invention.

3 Claims, 2 Drawing Sheets

UNIVERSAL BRAKE ASSEMBLY

CROSS-REFERENCE TO RELATED APPLICATIONS

This application is related to and claims priority from U.S. Provisional Patent Application Ser. No. 60/696,942 filed Jul. 6, 2005.

FIELD OF THE INVENTION

The present invention relates, in general, to a brake mechanism for use in railway vehicle brake assemblies and, more particularly, this invention relates to a brake mechanism using a pneumatic brake actuator assembly for initiating a braking sequence in railway vehicle brake assemblies and, still more specifically, the invention relates to truck-mounted brake assemblies.

BACKGROUND OF THE INVENTION

As is generally well known in the railway industry, truck mounted braking systems comprise a series of force transmitting members, levers and linkages which function to move a group of brake shoes against the wheels of a railway vehicle to effect stoppage of such railway vehicle. A pneumatic brake actuator is typically provided in the braking system to initiate movement of this series of force transmitting members, levers and linkages to apply the brakes of the railway vehicle mounted to a truck assembly of the railway vehicle.

Traditional pneumatic brake actuators generally comprise an air cylinder piston which moves in a forwardly direction within a cylindrical member upon the application of pneumatic pressure thereto. A seal and/or diaphragm is provided on or adjacent a first end of the piston. This seal and/or diaphragm contacts the inner surface of the cylindrical member so as to provide an airtight chamber at one end of the cylindrical member such that application of pneumatic pressure therein and against the first end of the piston enables forward movement of the piston.

A piston rod is attached at a second end of the piston and moves in response to the movement of the piston. An opposite end of the piston rod is connected to the end of a push rod which is, in turn, connected to a cylinder force transfer lever. This cylinder force transfer lever is connected through a series of force transmitting members and linkages so as to activate a braking sequence and apply the brake shoes to the vehicle wheels.

As it is well known, their inability to accommodate piston bail or misalignment without leaking air, need for maintenance of the seals and/or diaphragms within the cylindrical member to ensure that leaking of air does not occur and difficulties in controlling the movement and/or force applied by the piston are the main disadvantages of the airbrake cylinder.

SUMMARY OF THE INVENTION

The invention provides a universal brake actuator assembly that includes a first rigid member for connecting the brake actuator assembly to such second control linkage. A second rigid member is spaced from the first rigid member for securing the brake actuator assembly to at least one of such brake beam and such second force transmitting member. A flexible elastomeric member extends between and is directly and sealingly attached to the first and the second member which forms a sealed fluid chamber. A first retaining means is provided for directly and sealingly attaching a first end of the flexible elastomeric sleeve to a predetermined portion of the first member. A second retaining means is provided for directly and sealingly attaching a second end of the flexible elastomeric sleeve to a predetermined portion of the second member. There is a means disposed in one of the first member and the second member in open communication with the fluid chamber and in fluid communication with a source of fluid under pressure. Supply of the fluid under pressure will inflate the chamber causing longitudinal movement of the first member in a direction away from the second member and removal of the fluid under pressure will deflate the chamber causing longitudinal movement of the first member in a direction toward the second member. Selective inflation and deflation of the flexible elastomeric sleeve enables a reciprocal motion of the brake actuator assembly to move such control linkages and such force transmitting members for actuating and releasing such brake shoes.

According to another embodiment of the invention there is provided a brake actuator assembly which includes a flexible elastomeric member having a predetermined shape and a predetermined length and having a first open end and an axially opposed second open end. A first substantially vertically disposed plate like member has a first substantially planar surface portion for engagement with the first open end of the flexible elastomeric member. A first retaining means is provided for directly and sealingly attaching the first open end of the flexible elastomeric member to the first substantially planar surface portion of the first substantially vertically disposed plate like member. There is a means connected to a radially opposed second surface of the first substantially vertically disposed plate like member for securing it to a control linkage of a railway vehicle brake assembly. A second substantially vertically disposed plate like member has a first substantially planar surface portion for engagement with the second open end of the flexible elastomeric member. A second retaining means is provided for directly and sealingly attaching the second open end of the flexible elastomeric sleeve to the first substantially planar surface portion of the second substantially vertically disposed plate like member. A guide means is connected to and disposed closely adjacent a first outer edge of and substantially perpendicular to at least one of the first planar surface portion of a respective one of the first and the second substantially vertically disposed plate like members for guiding and aligning a reciprocal movement of the flexible elastomeric member. A securing means is connected to the second substantially vertically disposed plate like member for securing of the brake actuator assembly to a rigid structure. There is a means disposed in one of the first substantially vertically disposed plate like member and the second substantially vertically disposed plate like member in open communication with a fluid chamber formed by the sealingly attached flexible elastomeric member and in fluid communication with a source of fluid under pressure. A supply of the fluid under pressure will inflate the chamber causing longitudinal movement of the first member in a direction away from the second member and removal of the fluid under pressure will deflate the chamber causing longitudinal movement of the first member in a direction toward the second member. Selective inflation and deflation of the flexible elastomeric sleeve enables a reciprocal motion of the brake actuator assembly to move such control linkages and such force transmitting members for actuating and releasing such brake shoes.

OBJECTS OF THE INVENTION

It is an object of the present invention to provide a brake actuator assembly for a railway vehicle braking system that improves control of the brake shoe forces.

Another object of the present invention is to provide a brake actuator assembly that reduces the amount of pressure to be applied to the air spring actuator pushrod during light car conditions.

Still another object of the present invention is to provide a brake actuator assembly that is capable of linkage bail and/or misalignment without leaking air.

Yet another object of the present invention is to provide a brake actuator assembly that reduces effort required to maintain the air tightness of the system.

A further object of the present invention is to provide a brake actuator assembly that provides an economically desirable alternative to the seal/diaphragm system currently in use.

Still another object of the present invention is to provide a brake actuator assembly that provides for visual determination of its travel during brake actuation in order to determine the force applied by the brake shoes.

An additional object of the present invention is to provide a brake actuator assembly which has a positive stop in order to prevent over compression and consequently damage to the flexible elastomeric member.

Yet an additional object of the present invention is to provide a brake actuator assembly which can be easily retrofitted into existing applications.

Although a number of objects and advantages of the present invention have been described in some detail above, various additional objects and advantages of the brake cylinder of the present invention will become more readily apparent to those persons who are skilled in the art from the following more detailed description of the invention, particularly, when such detailed description is taken in conjunction with both the attached drawing figures and with the appended claims.

Figure 1:
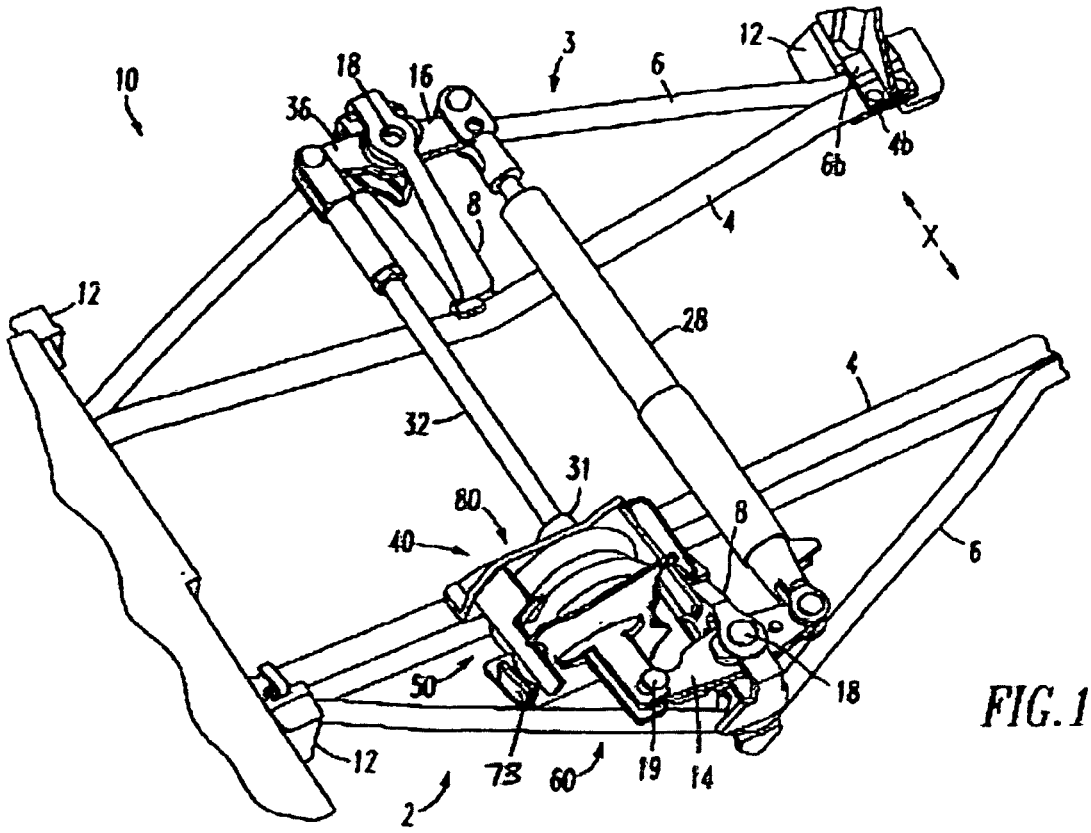
FIG. 1 is a perspective view of a railway vehicle truck mounted brake arrangement including a presently preferred embodiment of the universal brake assembly of the present invention.

DETAILED DESCRIPTION OF A PRESENTLY PREFERRED AND VARIOUS ALTERNATIVE EMBODIMENTS OF THE INVENTION

Prior to proceeding with the more detailed description of the invention, a description of a truck mounted braking system and its functioning should be helpful in understanding the present invention. Also, it should be noted that for the sake of clarity, identical components which have identical functions have been identified with identical reference numerals throughout the several views illustrated in the attached drawing figures.

Referring now to FIG. 1, there is shown a presently preferred embodiment of a truck-mounted brake assembly, generally designated 10, for a railway car (not shown). This brake assembly 10 comprises brake beams, generally designated 2 and 3, which are substantially identical. Each of the brake beams 2 and 3 includes a compression member 4, a tension member 6 and a strut member 8. The opposite ends of the compression member 4 and the tension member 6 may be permanently connected together, preferably by welding, along an outer segment (not shown) at the opposite ends of the compression member 4 and the tension member 6.

At a location substantially midway between their opposite ends, the compression member 4 and the tension member 6 of the, respective, brake beams 2 and 3 are spaced apart sufficiently to allow connection of the strut member 8 therebetween. Mounted on the respective outer end segments of the brake beams 2 and 3 are brake heads 12.

A pair of force-transfer levers 14 and 16 are pivotally connected by pins 18 to the strut member 8 of the respective brake beams 2 and 3. One end of the respective force-transfer levers 14 and 16 is interconnected via a force-transmitting member 28, which may be in the form of a slack adjuster device. The opposed end 36 of the force-transfer lever 16 is connected to a brake actuator assembly, generally designated 40, by connecting means 31 via a force-transmitting member or a return push rod assembly 32.

The brake actuator assembly 40 includes three essential members such as a flexible elastomeric member, generally designated 50, a first rigid member, generally designated 60, and a second rigid member, generally designated 80. The first rigid member 60 functions as a pushrod/shield and the second rigid member 80 functions as a mounting member 80 for brake actuator assembly 40. Each of the first rigid member 60 and the second rigid member 80 is preferably formed as a plate like member.

Figure 2:
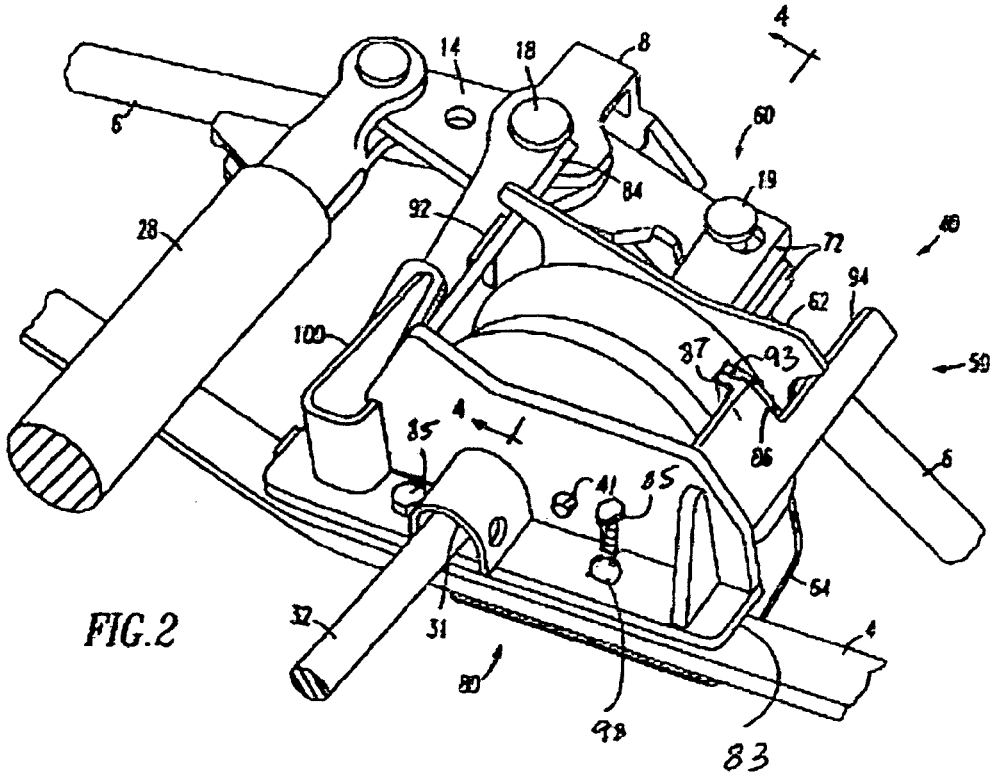
FIG. 2 is a partial perspective view of a railway vehicle truck mounted brake arrangement showing the brake actuator assembly of the present invention.

In further reference to FIGS. 1 and 2, when a brake application is made, pressurization of the flexible elastomeric member 50 of the brake actuator assembly 40 will result in movement of the first member 60 connected with the force transfer lever 14 in a forward direction to effect a counterclockwise rotation of such force transfer lever 14. The force transfer lever 14, in turn, actuates the slack adjuster assembly 28 to effect counterclockwise rotation of the force-transfer lever 16 and consequent actuation of the return push rod assembly 32.

The force-transfer levers 14 and 16, along with the slack adjuster assembly 28, the return push rod assembly 32 and the brake actuator assembly 40 comprise a brake beam actuating linkage that interconnects the, respective, brake beams 2 and 3 via the pivot pins 18 and thus the required brake actuation forces effectively act along these pivot pins 18. The resultant of these forces is shown at X. Because the slack adjuster assembly 28 acts as a rigid member during a brake application, it is important that the length of the slack adjuster assembly 28 be allowed to increase with brake shoe wear and/or loss of a brake shoe during service so that movement of the first member 60 will enable such brake beams 2 and 3 to be moved apart by the brake beams linkage until brake shoe engagement with the tread surface of the vehicle wheels occurs.

Any well-known technique may be used to position and/or mount the brake actuator assembly 40 to the braking system. For example, such brake actuator assembly 40 can be connected to both the strut member 8, adjacent one side thereof, and to the compression member 4 in the space located between the compression member 4 and the tension member 6. In this particular arrangement, the weight of the brake actuator assembly 40 and the force-transmitting members is carried by the brake beams 2 and 3, which are, in turn, supported by the truck side frames (not shown) . A connecting means 31 is provided for connecting a back portion of the mounting member with the return push rod 32.

Figure 3:
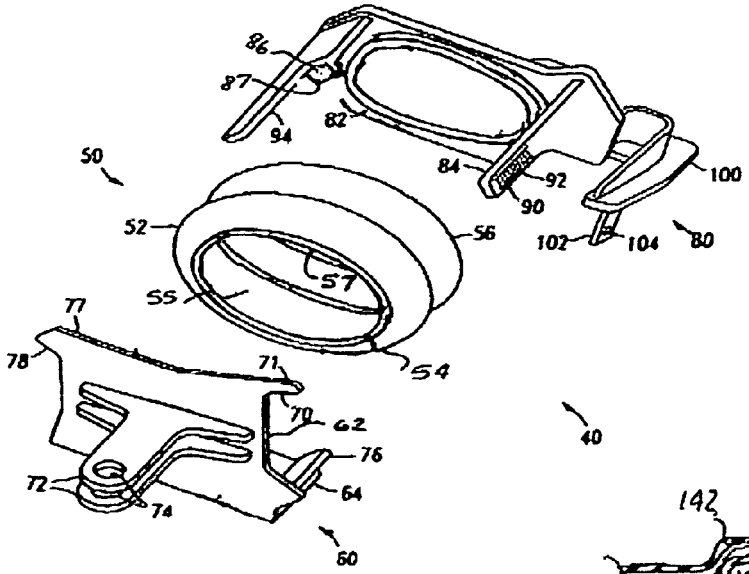
FIG. 3 is a perspective exploded view of the brake actuator assembly.

Now in a particular reference to FIG. 3, the flexible elastomeric member 50 is disposed intermediate and engageable with the first member 60 and the second member 80. The flexible elastomeric member 50 has a predetermined shape 52 and a predetermined length and has a first end 54 with a first aperture 55 and an axially opposed second end 56 with a second aperture 57. Preferably, the first aperture 55 and the second aperture 57 are identical. The preferred material of such flexible member 52 is a multi-ply rubberized fabric material. The presently preferred shape 52 of the flexible elastomeric member 50 is in a form of bellows. Alternatively, the flexible elastomeric member 50 may be formed as a simple cylindrical sleeve.

The first member 60 includes a first surface portion 62 which is substantially planar and disposed substantially vertical during operation of the brake actuator assembly 40.

A first retaining means, generally designated 120, is provided for directly, rigidly and sealingly attaching the first end 54 of the flexible elastomeric member 50 to the first surface portion 62 of the first member 60. According to one embodiment of the invention, the retaining means 120 includes an annular ring 122 which extends outwardly from an inner surface of the first member 60 and an annular flange 59 which extends outwardly from the first end 54 of the flexible elastomeric member 50 and is spaced therefrom. The annular flange 59 is fitted within the annular ring 130 and in abutment with the inner surface of the first surface portion 62. A portion 124 of annular ring 122 disposed adjacent a free edge thereof is folded over annular flange 59 for securing the first end 54 of flexible elastomeric member 50. A plurality of projections 126 may be disposed in a spaced relationship within the annular ring 122.

According to another embodiment of the invention, the retaining means 120 includes a bond formed between the first end 54 of the flexible elastomeric member 50 and at least the inner surface of the first surface portion 62 by one of a chemical and a mechanical bonding. The bond may be also formed during vulcanization of the flexible elastomeric member 50.

A second retaining means, generally designated 130, is provided for directly, rigidly and sealingly attaching the second end 56 of the flexible elastomeric member 50 to a first surface portion 82 of the second rigid member 80. Such first surface portion 82 is substantially planar and is disposed substantially vertical during operation of the brake actuator assembly 40.

Such second retaining means 130 includes an annular ring 132 which extends outwardly from an inner surface of the first surface portion 82 of the second member 80 and a clamp ring 136 which secures the second end 56 of the flexible elastomeric member 50 to an exterior surface of the annular ring 132. A plurality of either apertures 134 or projections 138 may be disposed in spaced relationship within annular ring 132.

It will be apparent to those skilled in the art that although the first retaining means 120 and the second retaining means 130 may be substantially identical to each other. For example, a clamp ring 136 may be employed in securing each end of the flexible elastomeric member 50 to a respective one of the first rigid member 60 and the second rigid member 80.

Figure 5:
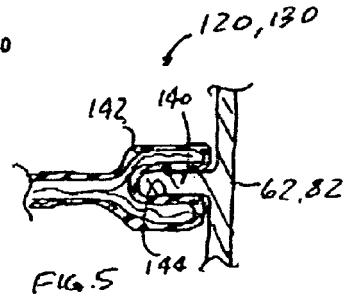
FIG. 5 is a partial cross-sectional view of the brake actuator assembly illustrating another embodiment of sealingly securing the flexible elastomeric member.
Figure 4:
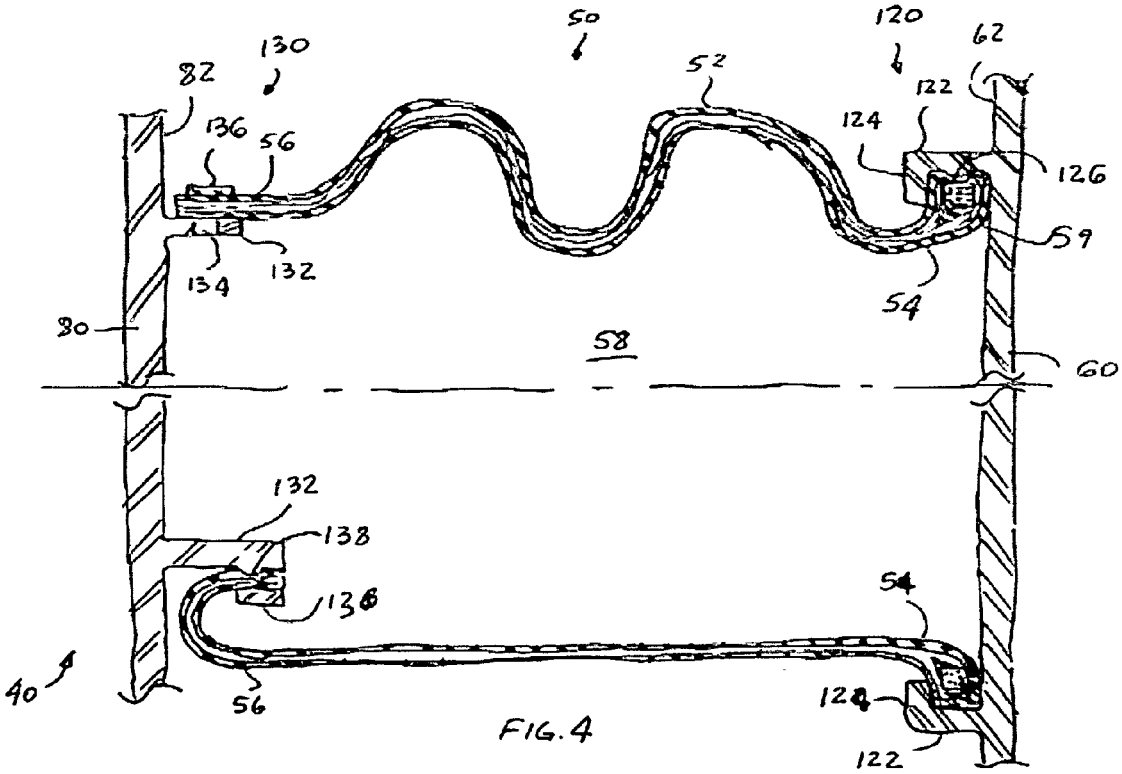
FIG. 4 is a partial cross-sectional view of the brake actuator assembly taken along the lines 4-4 of FIG. 2 illustrating an embodiment of sealingly securing the flexible elastomeric member.

According to yet another embodiment of the invention, best shown in FIG. 5, at least one of the first retaining means 120 and the second retaining means 130 includes an annular ring 140 which extends outwardly from the inner surface of at least one of the first rigid member 60 and the second rigid member 80 and an abutment 142 which is formed within the end of the flexible elastomeric member 50. A peripheral groove 144 is formed within the abutment 142 and encapsulates the annular ring 140. A bond is formed between the annular ring 140 and the abutment 142 during vulcanization of the flexible elastomeric member 50.

According to various retaining means described above, the first end 54 is rigidly and sealably attached to the first surface portion 62 of the first rigid member 60 and the second end 56 is rigidly and sealably attached to the second surface portion 82 of the mounting member 80, thus forming a sealed chamber 58. In application within the braking system 10, the first surface portion 62 and the second surface portion 82 are disposed substantially parallel to each other.

The brake actuator assembly 40 includes air communication means 41 for supplying air pressure to such sealed chamber 58 to inflate the flexible elastomeric member 50 during a brake application and also for removing or evacuating air from the sealed chamber 58 to deflate the flexible elastomeric member 50 during a brake release. In the presently preferred embodiment, this air communication means 41 is at least one air inlet port 41 disposed within the second rigid member 80.

Alternatively, the at least one air inlet port 41 may be disposed within the first rigid member 60. Such selective inflation and deflation of the flexible elastomeric member 50 enables a reciprocal motion of the brake actuator assembly 40 to move such control linkages 14 and 16 and such force transmitting members 28 and 32 for actuating and releasing such brake beams 2 and 3. Forces generated upon inflation of the sealed chamber 58 vary with respect to their travel height due to the natural characteristics of the rubber. The pressurization and discharge of the brake actuator assembly 40 is regulated by an external control circuit (not shown). Furthermore, these forces vary at the constant pressure applied to the brake actuator assembly 40.

The first rigid member 60 includes at least one and preferably a pair of force transfer lever engaging portions 72 extending outwardly from the outer surface of the fist surface portion 62 and are parallel to each other. An aperture 74 is formed within each force transfer lever engaging portion 72 for coupling to the force transfer lever 14 with a pin 19.

The outer surface of the elastomeric member 50 is exposed to an operating environment characterized by a presence of detrimental extraneous foreign material, such as rocks, debris and the like commonly encountered during railway vehicle movement.

In order to partially shield the outer surface of the flexible elastomeric member 50 from such detrimental extraneous foreign material, the first member 60 includes a plurality of second surface portions 64, 73 and 76 that extend outwardly from the first surface portion 62. Advantageously, the second surface portion 64 is planar and disposed substantially horizontally in relationship to the vertically disposed first surface portion 62 for shielding a bottom portion of the flexible elastomeric member 52. Second surface portions 73 and 76 are disposed adjacent each edge of the second surface portion 64 for shielding the lower side surfaces of the elastomeric member 50.

In the presently preferred embodiment of the invention, the second surface portions 64, 73 and 76 are formed integral to the first surface portion 62 by one of a bending, casting and forging process.

In further reference to FIG. 2, the second member 80 includes a flange 83 that extends outwardly from the rear surface of the first surface portion 82 and abuts the compression member 4. At least one cavity 98 is provided within the flange 83 for attachment of such second member 80 to the compression member 4 with a threaded fastener 85.

In the presently preferred embodiment of the invention, there are two apertures 98 formed within the flange 83. Furthermore, a partially tapered support portion 100 which engages the strut member 8 has a tab member 102 and at least one mounting aperture 104 for attachment to such strut member 8. Such support portion 100 is provided to substantially minimize force loads acting on the brake actuator assembly 40 upon actuation of the hand brake mechanism (not shown).

To provide for linkage bail and/or misalignment without applying loads to the brake actuator assembly 40, a first edge portion 70 and a second edge portion 78 extend outwardly from first surface portion 62 and are disposed substantially planar therewith and, respectively, engage a first edge portion 84 and a second edge portion 94 extending outwardly from first surface portion 82 and are disposed generally perpendicular thereto for guiding reciprocal movement of the brake actuator assembly 40.

In a presently preferred embodiment, edge portions 70, 78, 84 and 94 are formed integral to the respective first surface portions 62 and 82 by one of bending, casting and forging process.

In further reference to FIG. 3, a linear travel height indicator 92 is attached to a surface portion 90 of the second rigid member 80 for permitting determination of the forces generated upon pressurization of the brake actuator assembly 40 that vary with respect to their travel height due to the natural characteristics of the flexible elastomeric member 50.

In the presently preferred embodiment, upon discharge of the brake actuator assembly 40, a stop portion 77 of the first rigid member 60 will engage a third edge portion 86 of the second rigid member 80 preventing further motion of the brake actuator assembly 40 and, more particularly, preventing damage to the flexible elastomeric member 50.

Alternatively, stop portion 77 can be incorporated and disposed internally within flexible elastomeric member 50 having substantially identical functionality as edge portion 86. Furthermore, it is presently preferred that edge portion 86 is produced by one of bending, casting and forging process.

Alternatively, at least one wear resistant member 93 manufactured from a predetermined material, such a plastic, is attached to edge portion 86 for substantially minimizing damage to edge surface 77 during railway vehicle motion. Additionally, such damage is substantially minimized with edge portion 86 having an adjoining surface portion 87, which is substantially perpendicular to the edge portion 86.

Currently used brake cylinder assemblies may be retrofitted with the brake actuator assembly of the present invention by replacing the cylinder assembly with the brake actuator assembly having a predetermined push rod/shield and mounting bracket arrangements to interface with the existing brake assembly arrangement.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with a railway car mounted brake assembly including a pair of brake beams mounted at each end of such car mounted brake assembly, each of said brake beams having a brake head attachable to each end thereof, each of said brake heads carrying a brake shoe thereon, said each of said brake heads being positioned for engagement of a respective one of said brake shoes with a respective railway vehicle wheel during a brake application, said each of said brake beams having a control linkage pivotally attached thereto, a first force transmitting member attached to opposed first ends of each of said control linkages and a second force transmitting member attached to a second end of one of said control linkage and longitudinally extending toward a respectively opposed second end of an opposed one of said control linkage; a brake actuator assembly connectable to and disposed intermediate said second force transmitting member and said second control linkage for applying and releasing said brake shoes, said brake actuator assembly comprising:

(a) a first plate member disposed substantially vertically during use of said brake actuator assembly and having a first substantially planar inner surface;

(b) a second plate member disposed substantially vertically during use of said brake actuator assembly in spaced apart relationship with said first plate member and having a first substantially planar inner surface;

(c) a first ring disposed on and extending outwardly from said substantially planar inner surface of said first plate member and having an outer surface thereof spaced inwardly from said edges of said first plate member;

(d) a second ring disposed on and extending outwardly from said substantially planar inner surface of said second plate member and having an outer surface thereof spaced inwardly from said edges of said second plate member;

(e) a flexible elastomeric member extending between said first and said second plate members, said flexible elastomeric member having each of a predetermined length, a generally annular cross-section in a direction transverse to said predetermined length and an exterior peripheral surface thereof exposed to an operating environment characterized by a presence of detrimental extraneous foreign material, said flexible elastomeric member further having each open end thereof directly and sealingly secured to a respective one of said first and second rings in spaced relationship with edges thereof, said flexible elastomeric member forming a fluid chamber in combination with each of said first and second rigid members;

(f) means for connecting said brake actuator assembly to said control linkage;

(g) means for securing said brake actuator assembly to at least one of said brake beam and said second force transmitting member; and (h) an arrangement disposed in one of said first and second plate members in open communication with said fluid chamber and in fluid communication with a source of fluid under pressure, whereby supply of fluid under pressure will inflate said chamber causing longitudinal movement of said first rigid member in a direction away from said second rigid member and removal of said fluid under pressure will deflate said chamber causing longitudinal movement of said first rigid member in a direction toward said second rigid member, and whereby selective inflation and deflation of said flexible elastomeric sleeve enables a reciprocal motion of said brake actuator assembly to move said control linkages and said force transmitting members for actuating and releasing said brake shoes.

2. The brake actuator assembly, according to claim 1, wherein said means for connecting said brake actuator assembly to said control linkage includes at least one other plate member extending outwardly from an outer surface of said substantially vertical plate member and having an aperture formed therethrough and a pin member disposed in said aperture for securing said at least one other plate member to said control linkage.

3. The brake actuator assembly, according to claim 1, wherein said means for securing said brake actuator assembly to at least one of said brake beam and said second force transmitting member includes a flange which extends outwardly from a radially opposed substantially planar outer surface of said second rigid member, at least one aperture formed through said flange and at least one fastener member having a threaded stem passed through said at least one aperture.

* * * * *